United States Patent [19]

Wolfberg et al.

[11] Patent Number: 4,968,993

[45] **Date of Patent: * Nov. 6, 1990**

[54] PRINTING PRESS

[75] Inventors: Larry Wolfberg, Honolulu, Hi.; John Harper, Wichita, Kans.

[73] Assignee: L&C Family Partnership, Honolulu, Hi.

[ * ] Notice: The portion of the term of this patent subsequent to May 2, 2006 has been disclaimed.

[21] Appl. No.: 323,399

[22] Filed: Mar. 14, 1989

Related U.S. Application Data

[63] Continuation of Ser. No. 942,324, Dec. 16, 1986.

[51] Int. Cl.[5] ..... G03G 15/22

[52] U.S. Cl. ..... 346/160; 346/76 L; 355/212; 355/218; 355/310; 400/578

[58] Field of Search ..... 346/153.1, 460, 76 L; 355/218, 310, 212; 400/118, 119, 578, 581, 582, 583, 587, 593, 611, 614, 621; 229/69, 73

[56] References Cited

U.S. PATENT DOCUMENTS

| | | | |
|---|---|---|---|
| 2,539,068 | 1/1951 | Funk . | |
| 3,147,006 | 9/1964 | Fulk . | |
| 3,410,203 | 11/1968 | Fischbeck . | |
| 3,654,864 | 4/1972 | Ovshinsky . | |
| 3,836,917 | 9/1974 | Mee . | |
| 3,911,818 | 10/1975 | MacIlvaine . | |
| 3,965,476 | 6/1976 | Wenander et al. . | |
| 4,031,818 | 6/1977 | Kehoe . | |
| 4,046,471 | 9/1977 | Branham et al. . | |
| 4,322,971 | 4/1982 | Strobel . | |
| 4,348,100 | 9/1982 | Snelling . | |
| 4,528,580 | 7/1985 | Ihoue et al. . | |
| 4,611,908 | 9/1986 | Buch . | |
| 4,627,707 | 12/1986 | Tani et al. . | |
| 4,726,804 | 2/1988 | Stitcher | 229/69 X |
| 4,770,337 | 9/1988 | Leibe | 229/69 |
| 4,827,315 | 5/1989 | Wolfberg et al. | 346/160 |

OTHER PUBLICATIONS

1984 International Printing & Graphic Arts/Testing Conference, Russell Hill.
Tappi Journal, vol. 63, No. 3, Russell Hill.
Advanced Graphics Systems, Inc. brochure.
Abstracts from various publications.

*Primary Examiner*—Steven L. Stephan
*Assistant Examiner*—Emanuel Todd Voeltz
*Attorney, Agent, or Firm*—Banner, Birch, McKie & Beckett

[57] ABSTRACT

A method and apparatus for the automatic production of business forms, wallpaper, newspapers or the like from a web of continuous printing material comprises a printing station including an endless movable printing device such as a rotating cylinder. An image is projected to a surface of the device. The image is transferred to the web of continuous material at the printing station. Immediately after the printing station, the image is erased from the device so that a remaining portion of the image may be projected onto its surface. In this manner the device appears to provide a printing surface of indeterminate length and so is designed without relation to the image to be projected. A plurality of such printing stations may be arranged in series for color printing. Furthermore, the operation of the printing station and associated activities may be controlled by a pre-selected computer program.

30 Claims, 3 Drawing Sheets

PRINTING PRESS

This application is a continuation of application Ser. No. 942,324, filed Dec. 16, 1986.

BACKGROUND OF THE PRESENT INVENTION

This invention relates to a method and apparatus for automatically printing a web of paper in the production of business forms, or any form of printing that can adapt to this system, such as but not limited to, newspapers or publications with the copy transmitted nationwide from a central location, or as another example production of wallpaper from rolls with infinitely variable patterns.

In the art of manufacturing continuous, multi-part business forms, and in the printing press art in general, a major shortcoming is that the size of the print pattern is limited to the size, i.e., the diameter, of the printing cylinder. As a result, printing cylinders must be changed often in order to accommodate various lengths or repeats in the desired work product.

According to one exemplary embodiment of this invention, the printing cylinder has an indeterminate length in the sense that it is able to print at any desired length or pattern repeat without the necessity of changing cylinders. In this respect, the cylinder surface may be regarded as a constantly moving surface, miles long, rather than any fixed size. This is because an ionized beam is projected onto the cylinder to create an image thereon which is transferred to a continuously moving web. As the cylinder revolves past the printing position, the image is erased and another image is formed, so as to present a constantly changing image to the web for continuous printing independent of cylinder size.

More specifically, the drum or print cylinder is provided with an image receiving photoconductor surface which is rotated past a charging or projection station where laser beams are utilized to project images on the cylinder surface. This is accomplished using laser printing technology such as that disclosed in U.S. Pat. No. 3,836,917. The cylinder is then rotated to a development station where a powder or toner is selectively deposited on only the charged image areas. When a plurality of colors are used for a particular business forms application, as many as four or more cylinders are employed, each applying a single color.

After the image is transferred to the web, the sheet or web is passed through heating and chilling sections to fix the toner or powder on the web.

Meanwhile, immediately after the images from the respective cylinders are transferred onto the web, the images are erased, again with the aid of laser beams which discharge the photoconductive surfaces of the respective cylinders.

Upon passing through the various printing stations, the web is fed through a standard punch ring to an image scanner. At this station, the printed image may be reproduced, again with the aid of laser beams, and converted to digital form and stored in the computer. Conventional feedback techniques are then employed to correct and/or improve specific areas of the form, or to make minor changes in the form format.

The web thereafter passes through laser operated punch heads and cross-perforation devices and is subsequently wound on a rewind roll.

It is to be understood that computer technology is employed to program the press to produce the desired printing, color application and so on at each of the printing stations. In a preferred embodiment, controls to the press as well as printing information are included in diskette or cassette form.

The press as described hereinabove has several attendant advantages. The overall weight of the press is substantially reduced, alleviating problems of readjustment and realignment due to distortion of heavy frame members and compression of floor contours.

The press as described hereinabove will enjoy reduced power consumption since large motors (e.g., 7.5 hp) are utilized only to draw the paper through the press, with smaller additional motors (adding perhaps another 4 or 5 hp) used in the individual subsystems. This is to be compared with conventional prior art printing presses which normally use in excess of 50–60 hp.

The press according to an exemplary embodiment of this invention eliminates the use of conventional negatives and plates, along with the necessary chemicals. The computerization of all controls also eliminates the need for numbering machines and problems associated therewith.

The immediate drying of the ink at the respective printing stations eliminates the necessity of conventional infrared and ultraviolet dryers.

Conventional makeready procedures are also radically altered. With the press according to this invention, the operator need only install a fresh roll of paper in the press, remove the finished roll, and select the appropriate program for manufacturing a form of the desired size and format.

It is further contemplated that even the loading and unloading of the paper rolls themselves may be automated to even further reduce the already minimized manual labor associated with press operation.

Other objects and advantages of the invention will become apparent from the detailed description which follows.

DETAILED DESCRIPTION OF THE INVENTION

Figure 1:
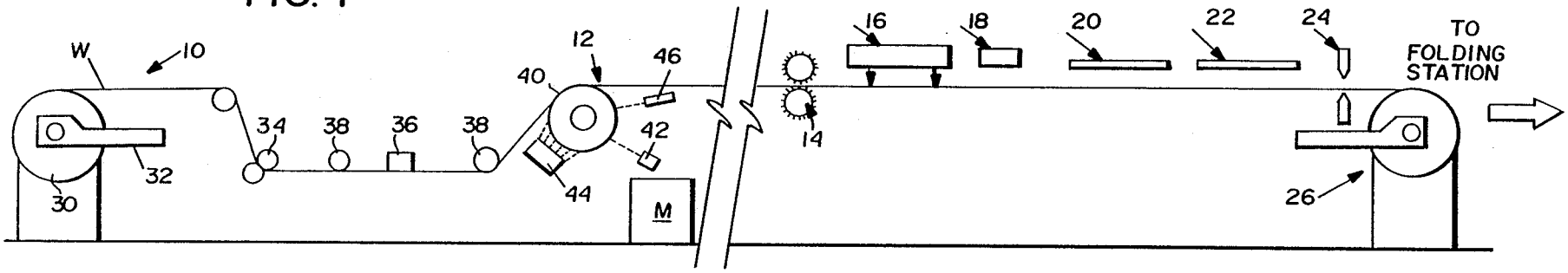
FIGURE 1 is a schematic side view of a business forms printing press in accordance with an exemplary embodiment of the invention.
Figure 2:
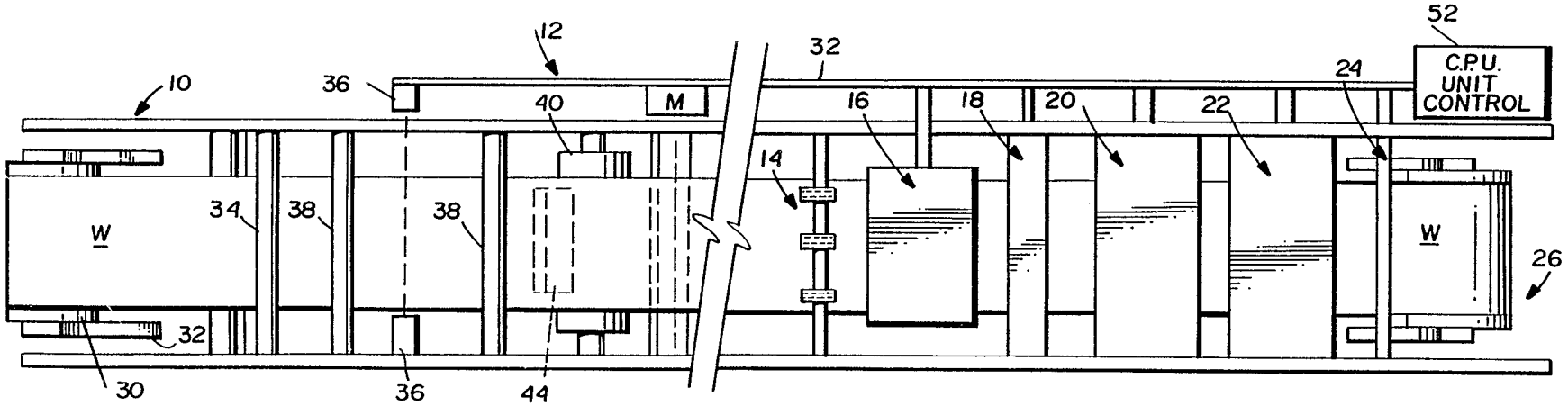
FIG. 2 is a schematic plan view of the press illustrated in FIG. 1.

Referring now to FIGS. 1 and 2, the business forms press of this invention generally includes an infeed supply station 10 for a web W, one or more printing stations 12, a line hole punch ring station 14, an image scanning station 16, a laser slitter station 18, a laser punch station 20, a laser cross perforation station 22, additional detectors 24 and a rewind station 26.

The infeed station 10 includes a conventional paper supply roll 30, provided with web guides 32 and feed rollers 34. In accordance with this invention, at least one laser detector 36 is provided for monitoring web thickness. While large variations in thickness are not normally found within a single paper roll, the second or third roll used in a process may, in fact, contain thickness variations large enough to create stretch problems in the web. The laser detector serves to alert the press operator of variations beyond a predetermined acceptable minimum so that the problem may be corrected. Detectors using laser radiation for measuring web thickness are not new per se. See, for example, U.S. Pat. No. 4,322,971 for a representative example of the type of detector which can be utilized in this invention.

A pair of compensator rolls 38 are employed in order to indicate slack and uneven feed of paper from the supply roll 30. These rolls are operatively connected with the central computer control unit 52 which adjusts the infeed rolls 34 as required.

The printing station 12 includes a unique, indeterminate length printing cylinder 40 which, as earlier stated, enables printing to any desired length or repeat.

In the present invention, each printing cylinder 40 (there may be as many as four or more arranged in series) is preferably constructed of aluminum and coated with a suitable photoconductive surface for receiving an image from an image projector 42. The projector 42 utilizes lasers to project an image onto the photosensitive recording medium applied on the drum surface. In this regard, it is to be appreciated that the drum or cylinder at each printing station should be mounted for easy installation and removal so that the cylinder may be removed periodically for recoating.

In a manner understood by those in the art of laser technology, the printing stations will receive, for example, alpha and numeric character data in electronic form from the main computer control unit 52, as will be described further hereinbelow, and, in response to such data, print the desired characters on the moving web W. Each printing station 12 may have its own light motor drive M and its own computer (not shown). This computer could have its own program to control spacing and tension of the web in that particular station, but would, of course, interface with the main computer control 52.

After the image is projected onto the surface of the cylinder, a toner in the form of powder is applied at 44. The powder should be extremely fine grained so that when it is picked up by the surface, there is no waste or extraneous material thereon.

Figure 4:
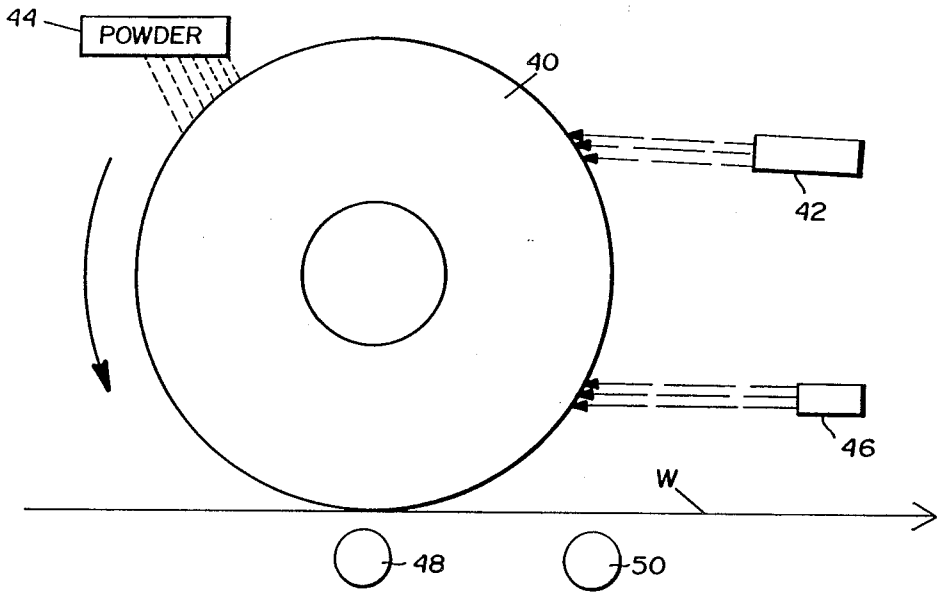
FIG. 4 is a schematic side view of a printing station in accordance with this invention.

After the characters have been applied to the web W as the drum surface rotates into engagement therewith, the powder is fused and chilled at 48, 50, respectively (see FIG. 4). Fusing temperatures should be greater than 300° F.

As the drum continues to revolve, the image is erased by an ionized image eraser 46. Here again, lasers are utilized to discharge the photoconductive surface of the printing drums or cylinders. Normally, the individual drums would be scanned to a required length, e.g., 24" on a 28" drum, and as the cylinder revolves past the printing point and the image is erased, a new or continuing image is projected on the cylinder. In this way, no open non-printing gaps are created.

It is to be understood that the size of the cylinder is not restricted to 28", but may be 22" or 26" or whatever size is most practical for the job at hand. In this regard, because of the effective infinite length of the cylinder, it is possible to print four (or more) 11" images and create a four-part form on a single sheet. Conventional printing presses, and even those with newer laser printers are unable to create such four-part forms.

The control and sequencing of the images to be projected on the drum will be discussed further hereinbelow.

As earlier stated, the laser drum printing station 12 described above is one of as many as four such stations, arranged in series along the path of travel of the web W, each one applying a different one of four primary colors. Obviously, the type and style of form will dictate the number of colors, and hence the number of stations required.

It will be understood that the press may be programmed to have the printing stations print in any given sequence, by color, so that, for example, the first station would print black; the second, red; the third, blue; and the fourth, green.

After exiting the printing stations, the web W passes through a conventional line hole punch ring station 14 and below an image scanner 16, and thereafter through a laser slitter 18, laser punch head 20 and laser cross perforation cutter 22. The size, location, spacing, and so on of the various holes and slits is governed by the use of pre-programmed information on diskettes or cassettes, insertable in the main control unit as described further herein.

The image scanner 16 reproduces the printed image and resolves the four color image in a lathe type mechanism, picks out the colors and separates them by digitilizing, and produces four separate negatives, one for each color. Rather than producing a negative, this information could be conveyed directly to the printing stations of the press, particularly to correct and/or improve the work product, or transmitted by computer link to a remote press or presses.

After passing between detectors 24, which insure proper alignment and tautness of the paper web W, the paper is rewound at a stand 26.

As is apparent from FIG. 2, the various components of the press are connected via cable 32 to the main central computer processing unit 52 which is described hereinbelow in more detail in association with FIG. 3.

Figure 3:
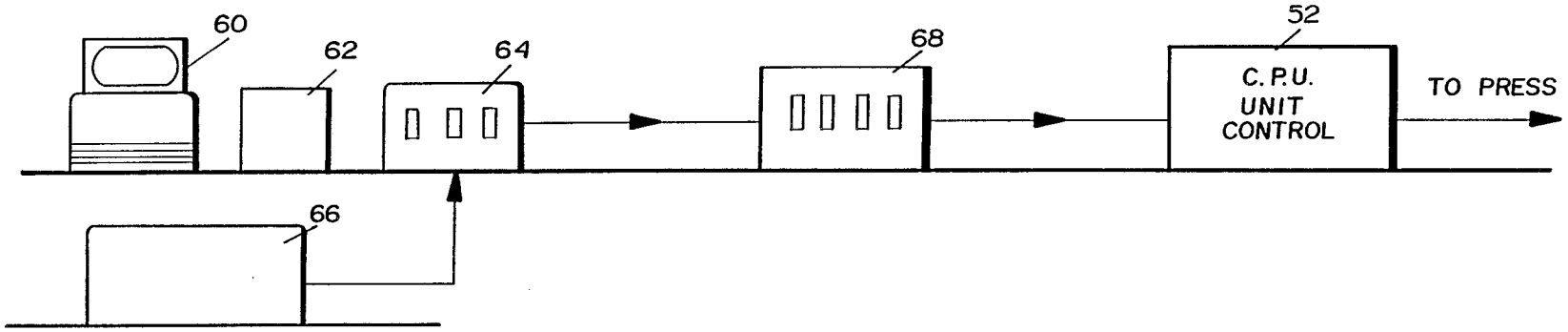
FIG. 3 is a schematic diagram of a central control unit for the printing press illustrated in FIGS. 1 and 2.

In FIG. 3 there is illustrated a schematic diagram of the various components utilized to control the press of this invention. A forms composer with full color graphics, shown at 60, and a matrix color printer 62 for forms proofs are utilized in conjunction with a processor 64 and color scanner 66 to provide the central processor 52 with the necessary information regarding the four color composition of the forms. A console 68 is provided for inserting the various cassettes or diskettes for controlling each of the stations of the press, through the main computer control 52.

When the job is finished, the diskette is stored for a repeat order, and is ready to set the press for an exact repeat, or the diskette can be altered with new or deleted copy, without the necessity for resetting the total job, or reworking the press memory diskette section when needed.

Turning to FIG. 4, there is shown a close-up schematic of a laser printing station similar to that illustrated in FIG. 1 but wherein the web W passes below a drum 40. As the drum rotates in a counterclockwise direction the image is projected onto the photosensitive surface of the drum at 42 and powder is applied at 44. After the image is transferred to the web W, the powder is fused at 48 and chilled at 50, while immediately thereafter, the image on the drum is erased at 46.

In its broader aspects, the invention relates to the production of business forms by a process which includes the steps of (a) feeding a web from a supply roll to a printing station including at least one rotary printing cylinder; (b) projecting an image on the cylinder as said cylinder rotates; (c) applying toner to the cylinder; (d) transferring the image to the web as the cylinder rotates into engagement with the web; (e) erasing the image from the drum immediately after the drum disengages from the web; and (f) projecting a new image on the cylinder as the cylinder continues to rotate.

Figure 5:
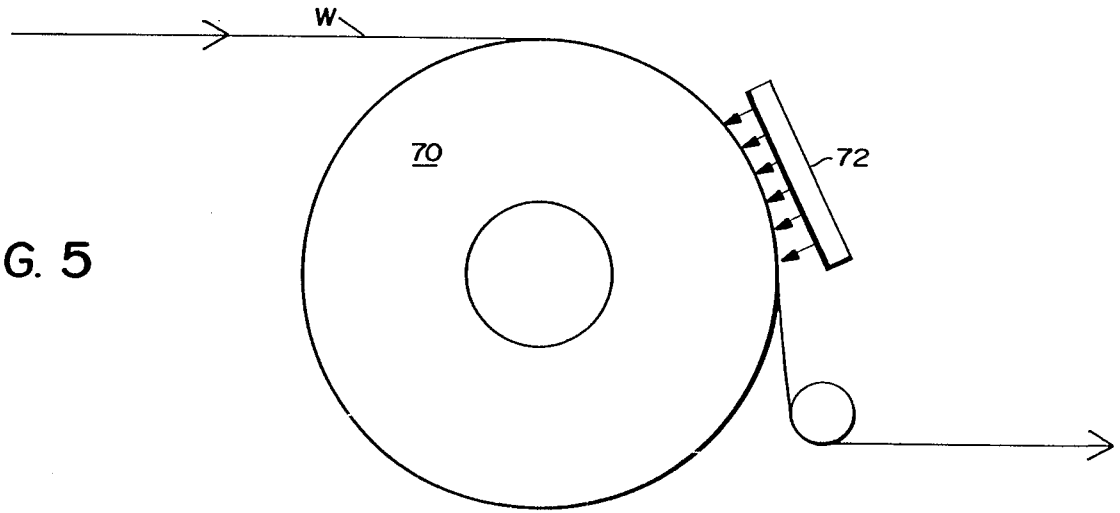
FIG. 5 is a schematic side view of an alternative embodiment of a printing station in accordance with this invention.

While the presently preferred process is carried out with printing stations utilizing laser printing technology, it will be understood by those skilled in the art that an ink jet type printer may also be employed. In FIG. 5, a web W is illustrated passing over and in contact with a drum 70 with an adjacent ink jet module 72 arranged to eject droplets of writing fluid or ink onto the web W in accordance with a selected computer program chosen to produce a particular business form.

The present invention has been described particularly in the context of printing business forms per se. It is contemplated that the computerized process of this invention may further be utilized to produce bar coding on the forms in a simple and efficient manner. It will be further appreciated that the indeterminate length cylinder as disclosed herein may also be advantageously employed in the production of other web-oriented processes, for example, in the publishing field, and in the printing of wallpaper. In the production of the latter, a customized product could be produced with a continuously varying pattern, i.e., at no point in a room need there be a pattern repeat.

It will be apparent that many additional changes and alterations may be made in the present invention without departing from the spirit and scope of the claims which follow.

What is claimed is:

1. A method of printing a web of continuous printing material on a printing press comprising the steps of:

(a) feeding the web of continuous printing material from a supply roll to a printing station;

(b) projecting at least a portion of an image to be printed on an endless moving printing device;

(c) transferring the image on said endless moving printing device to the web of continuous printing material at said printing station as the web and the image on said endless moving printing device move past each other;

(d) erasing the image from said endless moving printing device immediately after said printing station;

(e) projecting the remaining portion of the image to be printed on said endless moving printing device as it continues to move; and (f) repeating steps (c), (d) and (e) to continuously print on the web of continuous printing material until a complete image is printed.

2. A method as defined in claim 1 further comprising the steps of scanning the image transferred to the web for variations from a predetermined image design and compensating for such variations.

3. A method as defined in claim 1 wherein steps (a) through (f) are carried out at a plurality of printing stations, each printing station for printing in a different color.

4. A method as defined in claim 1 wherein step (b) is carried out utilizing a plurality of lasers.

5. A method as defined in claim 1 wherein said endless moving printing device is a rotary cylinder having a photoconductive surface.

6. A method as defined in claim 5 wherein said projection step projects a charged image on the photoconductive surface of said rotary cylinder, and wherein the method further comprises the step of applying toner to the charge image on the photoconductive surface of said rotary cylinder, and said transferring step transfers toner to the web of continuous printing material in accordance with the charged image.

7. A method as defined in claim 6 further comprising the step of fixing the toner image on the web of continuous printing material.

8. A method as defined in claim 1 wherein said projection step projects a constantly changing image.

9. A method as defined in claim 1 wherein said projecting step projects a succession of different images.

10. A method as defined in claim 9 wherein said transferring step successively transfers the succession of different images on said endless moving printing device to the web of continuous printing material and said erasing step erases the succession of different images from said endless moving printing device immediately after said printing station.

11. A method as defined in claim 1 further comprising the step of monitoring the thickness of the web prior to step (b).

12. A method as defined in claim 1 further comprising the steps of slitting or perforating the web in predetermined location, and rewinding the web.

13. A method as defined in claim 1 wherein steps (a) through (f) are controlled by a pre-selected computer program.

14. A method as defined in claim 1 further comprising the step of repeating steps (a) through (f) to continuously print a series of complete images.

15. A method of printing a web of continuous printing material on a printing press comprising the steps of:

(a) moving a web of continuous printing material from a supply roll to a printing station;

(b) projecting constantly changing images onto the peripheral surface of a printing cylinder having a predetermined diameter;

(c) transferring the constantly changing images onto the moving web of continuous printing material as it engages the peripheral surface of said printing cylinder, wherein the length of the image applied to the web is independent of the diameter of said printing cylinder; and (d) erasing the images from said printing cylinder immediately after step (c).

16. A method as defined in claim 15 further comprising the step of repeating steps (a) through (d) until a complete image to be printed is transferred to the web of continuous printing material.

17. A method as defined in claim 16 wherein the image to be printed is a business form and the constantly changing image is formed by at least alpha and numeric character data, the amount of alpha and numeric character data transferred to the web by said transferring step being independent of the diameter of said printing cylinder.

18. A method as defined in claim 15 wherein steps (a) through (d) are carried out in accordance with a preselected computer program.

19. A method as defined in claim 15 wherein steps (a) through (d) are carried out at a plurality of printing stations, each station for printing in a different color.

20. A printing press for continuously printing a web of continuous printing material comprising:

(a) feeder means for feeding the web of continuous printing material from a supply roll to a printing station;
(b) an endless movable printing device;
(c) drive means for driving said endless movable printing device past the printing station;
(d) projection means for projecting at least a portion of an image to be printed on said endless movable printing device;
(e) transfer means for transferring the image on said endless movable printing device to the web of continuous printing material at said printing station as the web and the image on said endless movable printing device move past each other;
(f) erase means for erasing the image from said endless movable printing device immediately after said printing station, said projection means, transfer means and erase means thereafter projecting, transferring and erasing the remaining portion of the image to be printed as said endless movable printing device and the web of continuous printing material continue to move past said printing station to thereby print a complete image on the web of continuous printing material.

21. A printing press as defined in claim 20 wherein said projection means, transfer means and erase means respectively project, transfer and erase a succession of images to be printed.

22. A printing press as defined in claim 21 wherein the succession of images to be printed are business forms formed by at least alpha and numeric character data, the amount of alpha and numeric character data in each image being transferred to the web by said transfer means being independent of the length of said endless movable printing device.

23. A printing device according to claim 20 wherein said projection means projects a constantly changing image.

24. A printing device according to claim 20 wherein said projection means, transfer means and erase means operate in response to a pre-selected computer program.

25. A printing device according to claim 20 wherein said endless movable printing device is a rotary cylinder having a photoconductive surface, said projection means charges the photoconductive surface with a charged image corresponding to the image to be printed, and said transfer means includes toner means for applying toner to the charged image on the photoconductive surface and transferring the toner to the web of continuous printing material to print the image as said rotary cylinder and the web move past each other, said printing device further comprising fixing means for fixing the toner on the web of continuous printing material and said erase means comprising discharge means for discharging the photoconductive surface of said rotary cylinder.

26. A printing press as defined in claim 20 wherein said projection means includes a plurality of lasers at each of a plurality of printing stations.

27. A printing press as defined in claim 20 further comprising forming means for slitting or perforating the web of continuous printing material.

28. A printing press as defined in claim 20 further comprising scanning means for scanning the image transferred to the web for variations from a predetermined image design and compensating means coupled to said scanning means for compensating for the variations.

29. A printing press as defined in claim 20 further comprising a plurality of printing stations, each printing station for printing in a different color.

30. A method of printing a web of continuous printing material on a printing press comprising the steps of:
(a) feeding the web of continuous printing material from a supply roll to a printing device;
(b) projecting at least a portion of an image to be printed on an endless moving printing device;
(c) transferring the image portion on said endless moving printing device to the web of continuous printing material at said printing station as the web and the image portion on said endless moving printing device move past one another;
(d) erasing the image portion from said endless moving printing device immediately after said printing station;
(e) projecting a remaining portion of the image to be printed on said endless moving printing device as ti continues to move; and
(f) repeating steps (c), (d) and (e) as necessary to continuously print on the web of continuous printing material until a complete image is printed.

* * * * *

US004968993B1

REEXAMINATION CERTIFICATE (2061st)

United States Patent [19]

Wolfberg et al.

[11] B1 4,968,993

[45] Certificate Issued * Jul. 13, 1993

[54] PRINTING PRESS

[75] Inventors: Larry Wolfberg, Honolulu, Hi.; John Harper, Wichita, Kans.

[73] Assignee: L & C Family Partnership, Honolulu, Hi.

Reexamination Request:
No. 90/002,792, Jul. 22, 1992

Reexamination Certificate for:

| | |
|---|---|
| Patent No.: | **4,968,993** |
| Issued: | **Nov. 6, 1990** |
| Appl. No.: | **323,399** |
| Filed: | **Mar. 14, 1989** |

[ * ] Notice: The portion of the term of this patent subsequent to May 2, 2006 has been disclaimed.

Related U.S. Application Data

[63] Continuation of Ser. No. 942,324, Dec. 16, 1986, Pat. No. 4,827,315.

[51] Int. Cl.[5] ..... G03G 15/22

[52] U.S. Cl. ..... 346/160; 346/76 L; 355/212; 355/218; 355/310; 400/578

[58] Field of Search ..... 346/157, 160, 76 L; 355/204, 212, 218, 219, 262, 275, 281, 300, 310, 311, 326, 111; 400/118, 119, 578, 581-583, 587, 593, 611, 614, 621; 229/69, 73

[56] References Cited

U.S. PATENT DOCUMENTS

| | | | |
|---|---|---|---|
| 2,539,068 | 1/1951 | Funk . | |
| 2,736,770 | 2/1956 | McNaney . | |
| 3,147,006 | 9/1964 | Fulk . | |
| 3,345,944 | 10/1967 | Simmons . | |
| 3,410,203 | 9/1964 | Fischbeck . | |
| 3,530,441 | 2/1970 | Ovshinsky . | |
| 3,574,456 | 4/1971 | Grace . | |
| 3,576,367 | 4/1971 | Sable . | |
| 3,654,864 | 4/1972 | Ovshinsky . | |
| 3,701,996 | 10/1972 | Perley . | |
| 3,836,917 | 9/1974 | Mee . | |
| 3,868,651 | 2/1975 | Ovshinsky . | |
| 3,911,818 | 10/1975 | MacIlvaine . | |
| 3,965,476 | 6/1976 | Wenander et al. . | |
| 3,983,542 | 9/1976 | Ovshinsky . | |
| 4,031,818 | 6/1977 | Kehoe . | |
| 4,046,471 | 9/1977 | Branham et al. . | |
| 4,297,716 | 10/1981 | Hirayama et al. . | |
| 4,322,971 | 4/1982 | Stroebel . | |
| 4,348,100 | 9/1982 | Snelling . | |
| 4,528,580 | 7/1985 | Ihoue et al. . | |
| 4,611,908 | 9/1986 | Buch . | |
| 4,627,707 | 12/1986 | Tani et al. . | |
| 4,726,804 | 2/1988 | Stitcher | 229/69 X |
| 4,770,337 | 9/1988 | Leibe . | |
| 4,827,315 | 5/1989 | Wolfberg et al. | 346/160 |

OTHER PUBLICATIONS

"Development and Application of Amorphous Semiconductors," by R. G. Neale and S. R. Ovshinsky, pp. 518-531.

1984 International Printing & Graphic Arts/Testing Conference, Russell Hill.

Tappi Journal, vol. 63, No. 3, Russell Hill Advanced Graphics Systems, Inc. brochure.

Abstracts from various publications.

*Primary Examiner*—Emanuel Todd Voeltz

[57] ABSTRACT

A method and apparatus for the automatic production of business forms, wallpaper, newspapers or the like from a web of continuous printing material comprises a printing station including an endless movable printing device such as a rotating cylinder. An image is projected to a surface of the device. The image is tranferred to the web of continuous material at the printing station. Immediately after the printing station, the image is erased from the device so that a remaining portion of the image may be projected onto its surface. In this manner the device appears to provide a printing surface of indeterminate length and so is designed without relation to the image to be projected. A plurality of such printing stations may be arranged in series for color printing. Furthermore, the operation of the printing station and associated activities may be controlled by a pre-selected computer program.

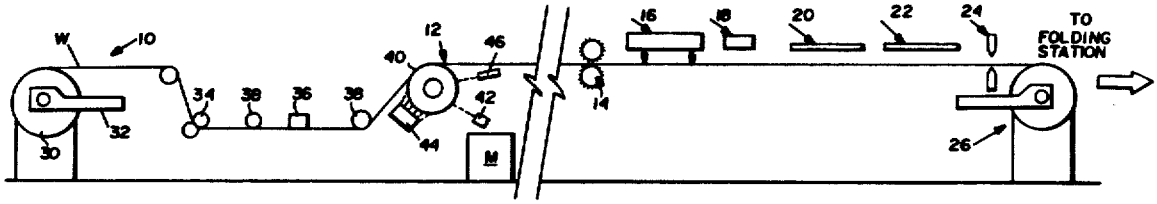

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-7, 9-14 and 20-30 is confirmed.

Claim 8 is cancelled.

Claims 15 and 17 are determined to be patentable as amended.

Claims 16 and 18-19, dependent on an amended claim, are determined to be patentable.

15. A method of printing a web of continuous printing material on a printing press comprising the steps of:

(a) moving a web of continuous printing material from a supply roll to a printing station;

(b) projecting [constantly changing images] *at least a portion of an image* onto the peripheral surface of a printing cylinder having a predetermined diameter;

(c) transferring the [constantly changing images] *image portion* onto the moving web of continuous printing material as it engages the peripheral surface of said printing cylinder, wherein the length of the image applied to the web is independent of the diameter of said printing cylinder; and (d) erasing the [images] *image portion* from said printing cylinder immediately after step (c).

17. A method as defined in claim 16 wherein the image to be printed is a business form and the [constantly changing image] *image portion* is formed by at least alpha and numeric character data, the amount of alpha and numeric character data transferred to the web by said transferring step being independent of the diameter of said printing cylinder.

* * * * *

US004968993C2

(12) EX PARTE REEXAMINATION CERTIFICATE (5296th)

United States Patent
Walfberg et al.

(10) Number: US 4,968,993 C2
(45) Certificate Issued: Mar. 7, 2006

(54) PRINTING PRESS

(75) Inventors: Larry Walfberg, Honolulu, HI (US); John Harper, Wichita, KS (US)

(73) Assignee: Xeikon NV, Mortsel (BE)

Reexamination Request:
No. 90/004,583, Mar. 19, 1997

Reexamination Certificate for:

| | |
|---|---|
| Patent No.: | **4,968,993** |
| Issued: | **Nov. 6, 1990** |
| Appl. No.: | **07/323,399** |
| Filed: | **Mar. 14, 1989** |

Reexamination Certificate B1 4,968,993 issued Jul. 13, 1993

Related U.S. Application Data

(63) Continuation of application No. 06/942,324, filed on Dec. 16, 1986, now Pat. No. 4,827,315.

(51) Int. Cl.
*B41J 2/385* (2006.01)
*G03G 15/22* (2006.01)

(52) U.S. Cl. ..... 347/118; 347/112; 347/154; 400/578

(58) Field of Classification Search ..... None
See application file for complete search history.

(56) References Cited

U.S. PATENT DOCUMENTS

| | | | | | |
|---|---|---|---|---|---|
| 2,539,068 | A | * | 1/1951 | Funk | |
| 3,410,203 | A | * | 11/1968 | Fischback | |
| 3,576,367 | A | * | 4/1971 | Sable | 347/140 |
| 3,654,864 | A | * | 4/1972 | Ovshinsky | |
| 3,836,917 | A | * | 9/1974 | Mee | |
| 3,911,818 | A | * | 10/1975 | MacIlveine | |
| 3,965,476 | A | * | 6/1976 | Wenander et al. | |
| 4,031,818 | A | * | 6/1977 | Kehoe | |
| 4,046,471 | A | * | 9/1977 | Branham et al. | |
| 4,286,031 | A | * | 8/1981 | Kuehnle | 101/131 |
| 4,297,716 | A | | 10/1981 | Hirayama et al. | |
| 4,322,971 | A | * | 4/1982 | Strobel | 73/159 |
| 4,348,100 | A | * | 9/1982 | Snelling | 399/1 |
| 4,528,580 | A | * | 7/1985 | Ihoue et al. | |
| 4,611,908 | A | * | 9/1986 | Buch | |
| 4,627,707 | A | * | 12/1986 | Tani et al. | |
| 4,718,340 | A | * | 1/1988 | Love, III | 101/116 |
| 4,726,804 | A | * | 2/1988 | Stitcher | 229/89 X |
| 4,729,310 | A | * | 3/1988 | Love, III | 101/157 |
| 4,770,337 | A | * | 9/1988 | Leibe | |
| 4,827,315 | A | * | 5/1989 | Wolfberg et al. | 346/160 |

FOREIGN PATENT DOCUMENTS

| | | | |
|---|---|---|---|
| EP | 0101266 | * | 2/1984 |

OTHER PUBLICATIONS

1984 International Printing & Graphic Arts/Testing Conference, Russell Hill.*
Tappi Journal, vol. 63, No. 3, Russell Hill Advanced Graphics Systems, Inc. brochure.*
Abstracts from various publications.*

* cited by examiner

*Primary Examiner*—Hai Pham

(57) ABSTRACT

A method and apparatus for the automatic production of business forms, wallpaper, newspapers or the like from a web of continuous printing material comprises a printing station including an endless movable printing device such as a rotating cylinder. An image is projected to a surface of the device. The image is transferred to the web of continuous material at the printing station. Immediately after the printing station, the image is erased from the device so that a remaining portion of the image may be projected onto its surface. In this manner the device appears to provide a printing surface of indeterminate length and so is designed without relation to the image to be projected. A plurality of such printing stations may be arranged in series for color printing. Furthermore, the operation of the printing station and associated activities may be controlled by a pre-selected computer program.

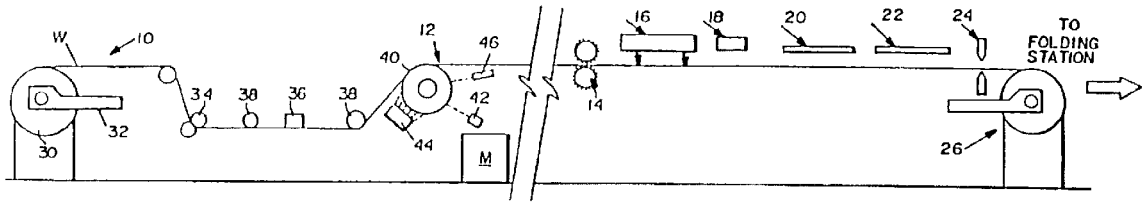

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 12 is confirmed.

Claim 8 was previously cancelled.

Claims 1–7, 9–11 and 13–30 are cancelled.

* * * * *